US011066132B2

(12) United States Patent
De Jongh et al.

(10) Patent No.: US 11,066,132 B2
(45) Date of Patent: Jul. 20, 2021

(54) BOAT TRANSFER SYSTEM

(71) Applicant: Kongsberg Maritime CM AS, Alesund (NO)

(72) Inventors: Martijn De Jongh, Ulsteinvik (NO); Richard White, Ulsteinvik (NO); Lars Fylling Eide, Alesund (NO)

(73) Assignee: Kongsberg Maritime AS, Horten (NO)

( * ) Notice: Subject to any disclaimer, the term of this patent is extended or adjusted under 35 U.S.C. 154(b) by 0 days.

(21) Appl. No.: 16/470,428

(22) PCT Filed: Dec. 15, 2017

(86) PCT No.: PCT/NO2017/050329
§ 371 (c)(1),
(2) Date: Jun. 17, 2019

(87) PCT Pub. No.: WO2018/111118
PCT Pub. Date: Jun. 21, 2018

(65) Prior Publication Data

US 2020/0108899 A1 Apr. 9, 2020

(30) Foreign Application Priority Data

Dec. 15, 2016 (NO) ..... 20161990

(51) Int. Cl.
*B63B 23/32* (2006.01)
*B63B 23/34* (2006.01)
(Continued)

(52) U.S. Cl.
CPC ..... *B63B 23/32* (2013.01); *B63B 23/34* (2013.01); *B63B 27/36* (2013.01); *B63C 3/12* (2013.01)

(58) Field of Classification Search
CPC ..... B63B 23/00; B63B 23/02; B63B 23/06; B63B 23/30; B63B 23/32; B63B 23/34;
(Continued)

(56) References Cited

U.S. PATENT DOCUMENTS 2,761,571 A 9/1956 Adams
4,797,055 A 1/1989 Tworoger et al.
(Continued)

FOREIGN PATENT DOCUMENTS

AU 1782683 A 2/1984
GB 785202 A 10/1957
(Continued)

OTHER PUBLICATIONS

Extended European Search Report for Application 17881978.5-1015 / 3554939 PCT/NO2017050329, Applicant: Kongsberg Maritime CM AS, dated Jul. 24, 2020.

*Primary Examiner* — Lars A Olson
(74) *Attorney, Agent, or Firm* — Flener IP & Business Law; Zareefa B. Flener

(57) ABSTRACT

Boat transfer system (10;110) on a floating vessel (30), comprising at least one deployment frame (14;114) for deployment of a cradle (12), wherein said deployment frame (14;114) is movable in a mainly horizontal direction and the deployment frame (14;114) is equipped with upright guides (18;118) for vertical movement of the cradle (12), and said cradle (12) is connected to a guide system (22;130,132,134) for controlled movement of the cradle (12) in the upright guides (18;118).

10 Claims, 3 Drawing Sheets

(51) Int. Cl.
*B63B 27/36* (2006.01)
*B63C 3/12* (2006.01)

(58) Field of Classification Search
CPC ..... B63B 27/00; B63B 27/14; B63B 27/36; B63C 1/00; B63C 1/02; B63C 3/00; B63C 3/12
USPC ..... 114/44, 48, 259, 365
See application file for complete search history.

(56) References Cited

U.S. PATENT DOCUMENTS

| | | | | |
|---|---|---|---|---|
| 4,976,211 | A | 12/1990 | Reinhardt | |
| 6,003,463 | A | 12/1999 | Giesler | |
| 6,591,770 | B1 * | 7/2003 | Blackmore | B63B 27/36 114/259 |
| 7,156,036 | B2 * | 1/2007 | Seiple | B63B 27/36 114/259 |
| 7,377,720 | B2 * | 5/2008 | Stewart | B63C 3/12 114/44 |
| 2015/0266550 | A1 | 9/2015 | Isbill | |
| 2017/0096202 | A1 | 4/2017 | Place | |

FOREIGN PATENT DOCUMENTS

| | | | |
|---|---|---|---|
| GB | 2012238 | A | 7/1979 |
| JP | 2007097177 | A | 4/2007 |
| NO | 20111341 | A1 | 4/2013 |
| WO | 8909723 | A1 | 10/1989 |
| WO | 9910229 | A1 | 3/1999 |
| WO | 2004022421 | A1 | 3/2004 |
| WO | 2006120593 | A1 | 11/2006 |

* cited by examiner

BOAT TRANSFER SYSTEM

FIELD OF THE INVENTION

The present invention relates to a boat transfer system (BTS), comprising a deployment frame for deployment of a cradle.

BACKGROUND OF THE INVENTION

The present invention is a a boat transfer system for lifting smaller craft "boats" on to a larger vessel "ship" and if required to both launch and recover boats.

DISCLOSURE OF THE STATE OF ART

Deployment and recovery of boats to and from larger vessel by conventional davit systems provides challenges in seaways with the boat swinging during the lifting operation. This presents danger to the boat and the occupants.

The present invention provides a system for deployment and recovery of boats in a controlled manner during the full operation.

WO 9910229 A1 disclose a launch and retrieval system for a smaller watercraft, such as a jet ski, comprising a cradle for a smaller watercraft, a first vertically oriented drive, a device for securing the cradle to the first drive for vertical movement for launch and retrieval of the watercraft, a second horizontally oriented drive for preferably aft mounting on a larger watercraft. The second drive has a low profile telescoping frame having a first part fixed to the aft mounting device and a telescopic second part. The drive has power means to reciprocate the second part relative to the first. A device is provided for mounting the first drive to the outboard end of the telescopic second part to position thereby the mounting of the first drive to the second drive at about swim platform level. The first drive elevates the cradle to a level for its storage position which permits second drive to retract at least a portion of the cradle to within the second drive.

DE 9307194 U1 relates to a lifting device for tenders on the stern of a greater motor boat or sailing yacht, comprising motor driven double telescopic devices.

Reference is also made to JP 2008013025 A, WO 2012105894 A1 and US 2014060414 A1.

US 2017/096202 A1 relates to a boat handling apparatus includes a carriage frame supported for rolling movement along a first horizontal track between a lifting position adjacent to a first end of the first track and a stored position adjacent to an opposing second end of the first track. A second upright track is fixed in proximity to the first end of the first track to depend downwardly from the first track. A cradle frame which is arranged to support a boat thereon is transferrable from a raised position supported on the carriage frame so as to be movable with the carriage frame between lifting and storage positions thereof, to a lowered position in which the cradle frame is movable up and down along the second track below the first horizontal track.

GB 785202 A discloses a platform on a carriage adapted to be raised or lowered on the side of a ship or dock by hydraulic means, the carriage being movable along rails when the platform is raised. The platform may be moved up or down by cylinders, or away from the ship's side by cylinders U.S. Pat. No. 4,976,211 A discloses a system for launching a boat that includes a platform which is movable horizontally over the edge of a seawall, a dock or the like.

Once the platform has been moved over the edge of the seawall, it then may be lowered vertically under the surface of the water. Once under the surface of the water, the boat may be floated away from its support on the platform.

OBJECTS OF THE PRESENT INVENTION

The present boat transfer system can be configured to suit a variety of ships and boats. It may also be used on offshore windfarms. Among the applications are rescue operations at sea in the event of a marine incident, where the ship uses the BTS to recover lifeboats from the water to the deck of the ship, the boat survivors remaining in the boat during the operation and transferring dryshod to the deck of the ship. Survivors can also be recovered from the water and taken on board using the BTS without being rolled or squeezed, or transferred from the large life rafts used on some passenger ships.

Alternatively the boat transfer system can be configured for the dedicated frequent or infrequent deployment of specific boats.

The invention is adaptable and scalable. It can hoist and take on board lifeboats whether conventional, freefall or hyperbaric, daughter craft and other small craft.

This is done under full control and without disembarking survivors first. With the boat safely stowed on the ship, survivors can go safely and directly on deck or into a covered reception area.

The invention is also applicable to a cylinder operated multi-arm system, such as a knuckle boom handling unit designed to handle an object (cradle) from a park position to a launch position over the side or through a moonpool of a vessel or any suitable offshore installation. It can also include a wire winch for lifting and lowering the object in a vertical direction.

The invention provides at least some of the benefits:

No pendulum effect on object (cradle) or 3rd party equipment.

Object secured to rail extension element(s) and docking head during on deck handling and vertical rails and wire winch during launch and recovery.

Together with a cradle the handling unit(s) can handle 3rd party equipment, such as a rescue boats or daughter craft, in a safer way than today's solutions using only lifting line.

Compact design, less space demanding when parked

SUMMARY OF THE INVENTION

The objects are achieved with a boat transfer system on a floating vessel, comprising at least one deployment frame for deployment of a cradle, wherein said deployment frame is movable in a mainly horizontal direction and the deployment frame is equipped with upright guides for vertical movement of the cradle, and said cradle is connected to a guide system for controlled movement of the cradle in the upright guides.

The boat transfer system may comprise first upright guides and second upright guides.

The deployment frame is in an inner position in a parked position, and the deployment frame is in an outer position in an operational launch position, wherein the first upright guides is aligned with the second upright guides mounted below the first upright guides.

The cradle can be driven from the first upright guides to the second upright guides, or vice versa.

In one embodiment the deployment frame can be horizontally skidable on a fixed frame, in where the fixed frame is overhead mounted in a foundation.

In another embodiment the deployment frame can be horizontally skidable on a fixed frame, wherein the fixed frame is base mounted on an underlying foundation.

The guide system can be connected to a hoisting/lowering system.

In one embodiment the guide system can comprises a winch and optionally wire sheaves for hoisting and lowering of the cradle.

The cradle may comprise a self-draining rescue net stretched across the cradle.

The cradle can be made from steel sections and tubes, and be of a general U-shape with fendering or perforated walls.

In a further embodiment the deployment frame for the movement in the mainly horizontal direction can be connected to an articulated multi-arm system.

The first upright guides for vertical movement of the cradle are vertically connected to the articulated multi-arm system.

The first upright guides is at an upper end connected to an upper arm of the articulated multi-arm system, and a lower end of the first upright guides is skidable connected to a lower arm of the articulated multi-arm system.

The deployment frame can in an inner position be in a parked position when the multi-arm system is retracted, and when the multi-arm system is extended the deployment frame can be in an outer position and in an operational launch position, wherein the first upright guides is aligned with second upright guides mounted below the first upright guides.

The second upright guides are preferable mounted on a side of the vessel, and the second upright guides is mounted below the first upright guides, and wherein the cradle is driven from the first upright guides to the second upright guides, or vice versa.

The deployment frame can comprise a docking head or latch for connection of the cradle.

The lower arm of the articulated multi-arm system can comprise an integrated rail, and possible wheels attached to the lowermost end of the first upright guides, to ensure smooth movement during tilting of the multi-arm system.

DESCRIPTION OF THE DIAGRAMS

Embodiments of the present invention will now be described, by way of example only, with reference to the following diagrams wherein.

DESCRIPTION OF PREFERRED EMBODIMENTS OF THE INVENTION

Figure 1:
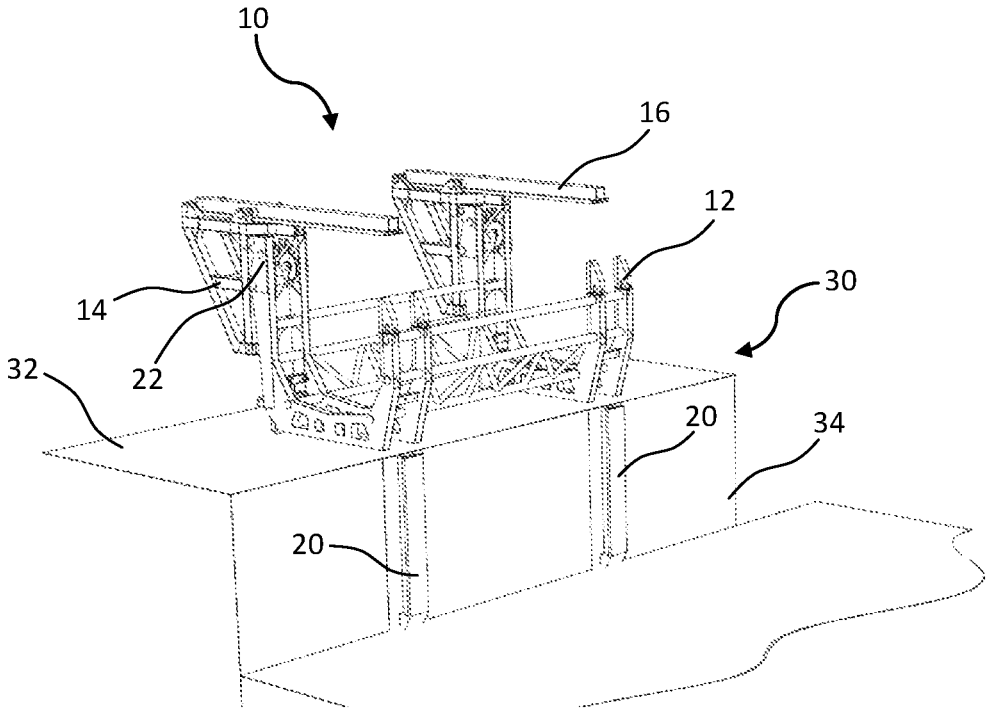
FIG. 1 shows a first embodiment of a boat transfer system according to the invention in a retracted position and overhead mounted in a foundation.

The invention relates to a boat transfer system 10;110 on a floating vessel 30 or similar, and comprises at least one deployment frame 14;114 for deployment of a cradle 12. The deployment frame 14;114 is movable in a mainly horizontal direction, and the deployment frame 14;114 is equipped with first upright guides 18;118 for vertical movement of the cradle 12. The cradle 12 is further connected to a guide system 22;130,132,134 for controlled movement of the cradle 12 in the first upright guides 18;118.

Two similar systems can be placed side by side to operate one cradle 12.

The boat transfer system 10;110 may comprise first upright guides 18;118 and second upright guides 20;120. The deployment frame 14;114 is in an inner position in a parked position, and the deployment frame 14;114 is in an outer position in an operational launch position, such that the first upright guides 18;118 is aligned with the second upright guides 20;120 mounted below the first upright guides 18;118.

Figure 2:
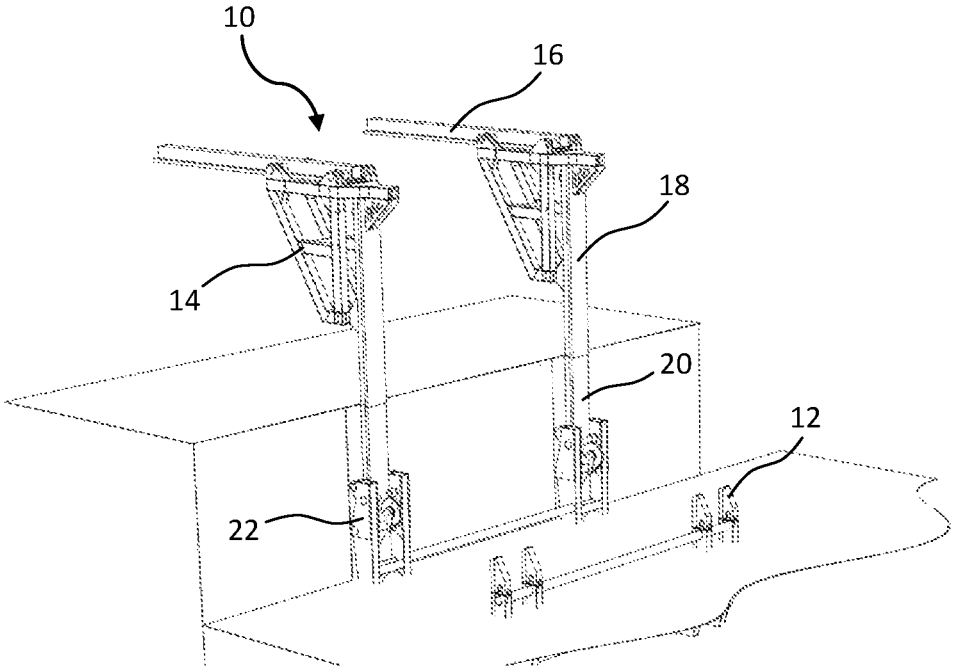
FIG. 2 shows the boat transfer system of FIG. 2 with a deployed cradle.

The first and second embodiment of the invention shall now be described with reference to FIGS. 1-3.

The boat transfer system 10 according to the first and second embodiment of the invention may have the following main components:

A cradle 12.

A deployment frame 14.

A fixed frame 16 attached temporarily or permanently to the ship or vessel 30.

Guides 18 on deployment frame 14.

Optional guides 18 on hull 34.

Guide system 22.

In the stowed position the cradle 12, attached to the moving deployment frame 14 by guides and hoisting system, is retracted inboard within the fixed frame 16.

Figure 4:
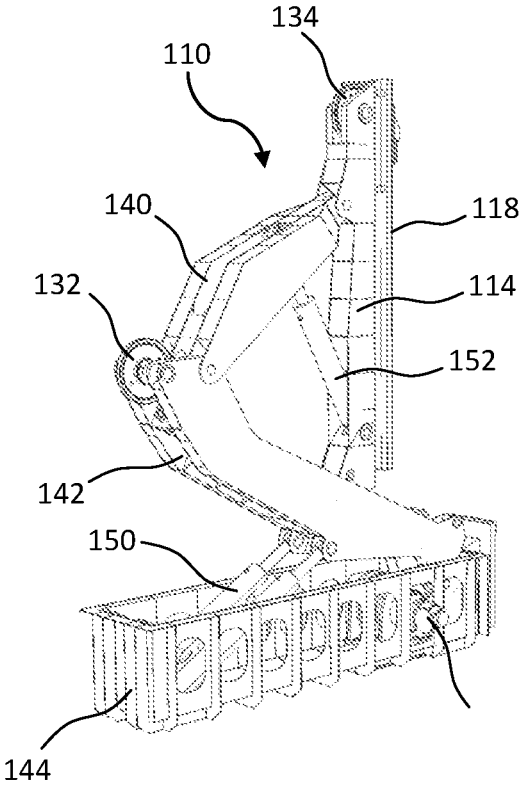
FIGS. 4 and 5 show a third embodiment of a boat transfer system according to the invention.
Figure 5:
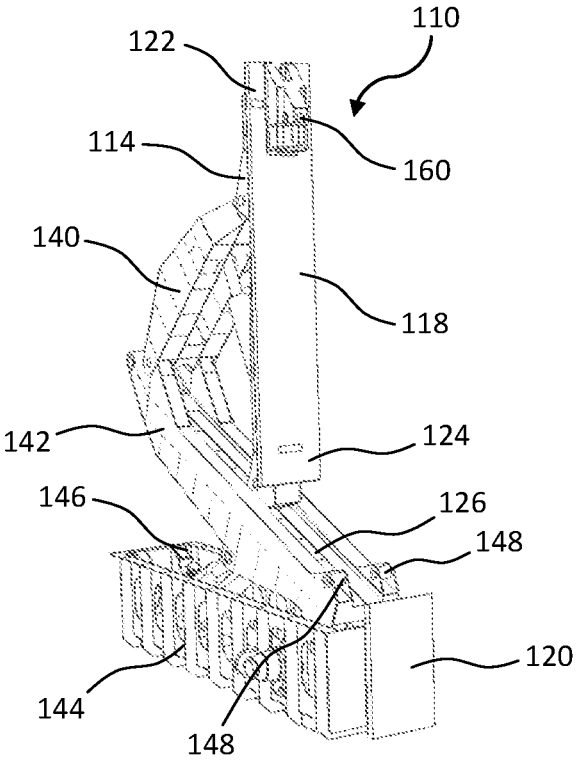
Figure 6:
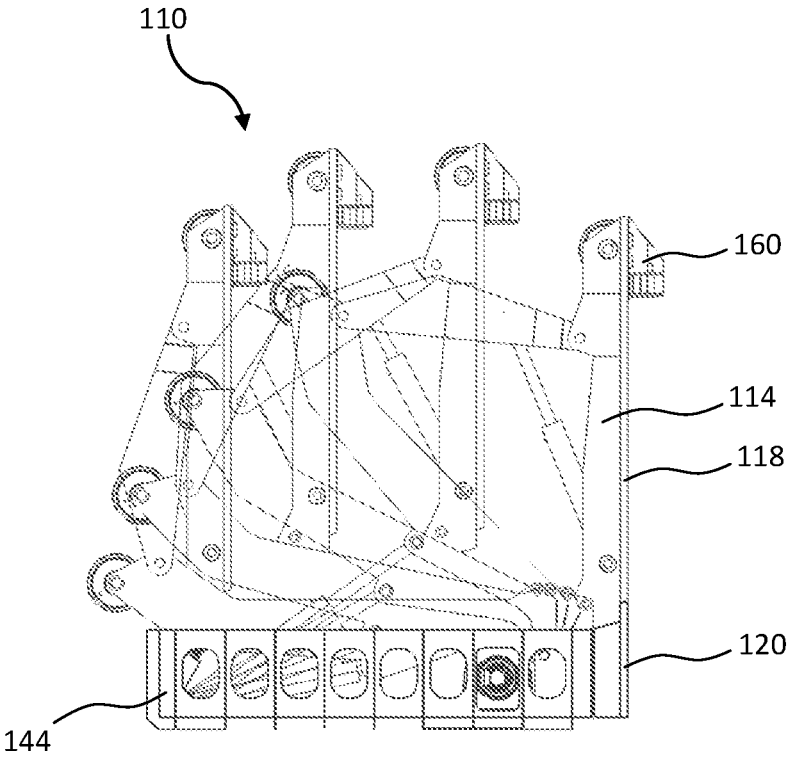
FIG. 6 shows movement of the third embodiment shown in FIGS. 4 and 5.

To deploy the cradle 12 the deployment frame 14, which may also be a cylinder/multi-arm (as seen in FIG. 4-6), moves on horizontal guides on the fixed frame 16 until the inner edge of the cradle 12 is just beyond the ship's side 34. The cradle 12 is then lowered, for example by a winch attached to the deployment frame 14, or by other means.

First upright guides 18 placed vertically on the deployment frame 14 control the cradle 12 so that it can be hoisted or lowered, i.e. move vertically, but cannot swing sideways or fore and aft despite rolling or pitching of the ship 30. There may be additional guides 20 attached to the ship's side 34, forming an extension of the guides for the deployment frame.

The guides in all embodiments can be tracks or similar, but are not shown in detail in the drawings.

The boat transfer system operator lowers the cradle 12 into the water to a depth that allows the subject boat (not shown) to enter the open end of the cradle 12. The boat cox then drives the boat into the cradle 12 to touch the closed far end, keeping power on until the boat transfer system 10 raises the cradle, and with it the boat.

The cradle 12 incorporates one part of the guide system 22 engaging with the deployment frame 14 and optionally with fixed guides 20 attached to the ship in the freeboard region.

The deployment frame 14 controls the vertical movement of the cradle 12 with a guide system and hoisting/lowering system. The guides 18,20 are arranged so that the cradle can only move up and down, and can not swing away from the ship's side 34 under the influence of waves or ship 30 motion or tilt.

The fixed frame 16, attached to the ship 30, controls the sideways motion of the deployment frame 14 and cradle 12. Guides and an actuating mechanism move the deployment frame 14 with cradle 12 from the stowed position within the outline of the ship 30 to the deployment position where the inboard face of the cradle 12 is just beyond the ship's side 34 and the first vertical guides 18 on the deployment frame 14 and the second freeboard guides 20 line up.

The fixed frame 16 may be a complete freestanding unit bolted or welded to the ship's deck 32, an open frame or incorporating a housing to protect the boat transfer system in harsh climates. Or the guiding/traversing elements may be incorporated in the structure of the ship 30. Steps and ramps may be included for safe movement of personnel.

Figure 3:
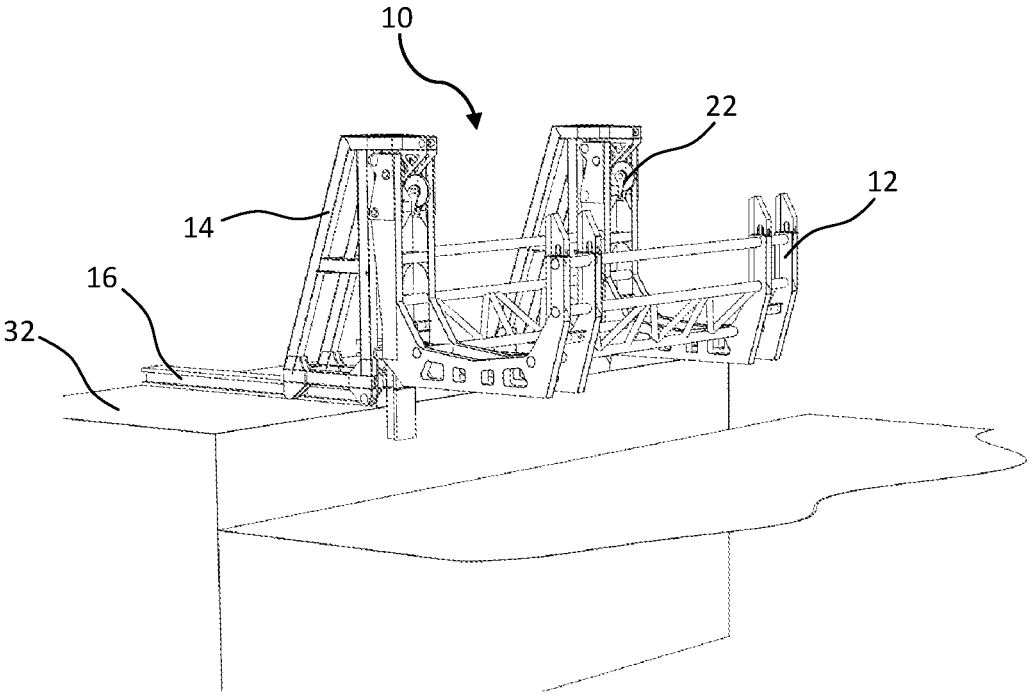
FIG. 3 shows a second embodiment of a boat transfer system according to the invention in a partially retracted position and base mounted on a foundation.

The deployment frame 14 may be hung from the movable part of the fixed frame 16 (FIGS. 1 and 2) or the guides for the movable element may be fixed directly to, or recessed into, the deck 32 of the ship 30 (FIG. 3). In the first case the fixed frame 16 is overhead mounted to an overlaying structure (not shown) of the ship 30.

The third embodiment of the invention shall now be described with reference to FIGS. 4-6. The third embodiment can be used similar as disclosed above.

The boat transfer system 110 according to the third embodiment of the invention may have the following main components:

A foundation or support structure 144.

A lower arm or boom 142.

An upper arm or boom 140.

First upright guides 118.

A docking head/latch 160.

Wire sheaves 132,134.

An upper boom tilt cylinder 152.

A lower boom tilt cylinder 150.

A wire winch/hoisting winch 130.

Locking pawl(s) 148 for the first upright guides 118.

Second upright guides 120, as a vertical rail extension element and end stopper.

A handling unit park end-stopper 146.

The third embodiment of the invention comprises cylinder operated multi-arm system with a tiltable lower arm 142 or boom and an upper arm 140 or boom enabling a rail extension element, i.e. the first upright guides 118, fixed to a deployment frame 114 and the object to be handled (cradle 12), to maintain a vertical position throughout the travel from parked to operational position (as seen in FIG. 6). This is done by means of hydraulic cylinders 150,152. An integrated rail 126 in the lower arm 142, and possible wheels attached to the lower most end of the first upright guides 118, ensures smooth movement during tilting. An end-stopper ensures that the first upright guides 118 are aligned with the connecting vertical rail extension element, i.e. the second upright guides 120, before operation can start. Additional vertical rails can be connected to the bottom of the second upright guides 120 to increase the vertical travel length.

The cylinder operated multi-arm system can be designed as a knuckle boom crane.

A foundation/support structure 144 may be used to support the lower arm or boom 142 and the lower boom tilt cylinder 150. It can also include foundation for a wire winch 130 and handling unit park end-stopper 146.

The cradle 12 is connected to the handling unit(s) docking head/latch 160 when handled between park- and launch position, and the wire winch 130 runs in a tension mode to prevent wire slack. During operation along the hull side 34, (from deck 32 to submerged end stop) the load from the cradle 12 is handled by the wire winch 130. The wire runs from the wire winch 130, via the integrated wire sheaves 132,134 to the connection point on the object to be handled (cradle 12). The cradle 12 uses the vertical rail on the first upright guides 118 and second upright guides 120 for guidance. During this operation the first upright guides 118 is secured to the lower arm or boom 142 using locking pawl(s) 148. Similar locking pawl(s) can also be used in the first and second embodiment of the invention.

The unit 110 as shown in the drawings can be arranged as a stand-alone unit or in combination with two or more units working together. In such a case the two wire winches 130 can be linked together using a torsion pipe (not shown).

The cradle 12 may be made from steel sections and tubes or other material. It may be of a generalized U-shape, closed at one end, with fendering or perforated walls to suit the particular application. In end elevation, the lower part may be of different shapes either to accommodate unspecified boats or to cradle a specific boat hull form. Or a series of flexible strops within the cradle may be used to locate a boat.

The system can also be used to retrieve persons from the water of from other floating objects that do not fit in the cradle. The cradle 12 may thus comprise a self-draining rescue net (not shown) stretched across the cradle 12.

In a major incident where in addition to survivors in lifeboats there are people in the water, in life rafts or in the large rafts associated with passenger evacuation systems, the self-draining fine net 'trampoline' can be stretched across the cradle 12 at various heights. Lowered to just below the surface the net can receive swimmers. If it is raised a little above the water survivors can get on to it from rafts without going into the water, and be lifted to deck level or inboard. The aim is to avoid survivors having to climb scrambling nets or be pulled up the ship's side. Ship personnel may go on to the "trampoline" to assist survivors suffering from injuries or hypothermia.

The location of the boat transfer system on the ship or foundation is not predefined. For example it can be at the side or the stern as suits the ship and the application.

Given a suitable ship with vacant deck area, empty boats can be extracted endwise from the stowed cradle and parked on deck, freeing the system to take up the next boat.

The boat transfer system controls may be local or remote. Safety and locking devices can be incorporated to ensure that all phases of the operation are under full control.

The invention claimed is:

1. A boat transfer system on a floating vessel, comprising at least one deployment frame for deployment of a cradle, wherein said deployment frame is movable in a mainly horizontal direction and the deployment frame is equipped with first upright guides for vertical movement of the cradle, and said cradle is connected to a guide system for controlled movement of the cradle in the first upright guides, and wherein said deployment frame for the movement in the mainly horizontal direction is connected to an articulated multi-arm system, and wherein said boat transfer system further comprises second upright guides, wherein the deployment frame in an inner position is in a parked position, and the deployment frame in an outer position is in an operational launch position, wherein the first upright guides are aligned with the second upright guides mounted below the first upright guides, and wherein said cradle is driven from the first upright guides to the second upright guides, or vice versa.

2. The boat transfer system according to claim 1, wherein the cradle comprises a self-draining rescue net stretched across the cradle.

3. The boat transfer system according to claim 1, wherein the cradle is made from steel sections and tubes, and is of a general U-shape with fendering or perforated walls.

4. The boat transfer system according to claim 1, wherein the second upright guides are mounted on a side of the vessel, and said second upright guides are mounted below the first upright guides, and wherein the cradle is driven from the first upright guides to the second upright guides, or vice versa.

5. The boat transfer system according to claim 1, wherein the first upright guides for vertical movement of the cradle are vertically connected to the articulated multi-arm system.

6. The boat transfer system according to claim 5, wherein the first upright guides at an upper end are connected to an upper arm of the articulated multi-arm system, and that a lower end of the first upright guides is skidable connected to a lower arm of the articulated multi-arm system.

7. The boat transfer system according to claim 6, wherein the lower arm of the articulated multi-arm system comprises an integrated rail, and possible wheels attached to the lowermost end of the first upright guides, to ensure smooth movement during tilting of the multi-arm system.

8. The boat transfer system according to claim 1, wherein the deployment frame in an inner position is in a parked position when the multi-arm system is retracted, and when the multi-arm system is extended the deployment frame is in an outer position and in an operational launch position, wherein the first upright guides are aligned with the second upright guides mounted below the first upright guides.

9. The boat transfer system according to claim 1, wherein the guide system comprises a winch and wire sheaves for hoisting and lowering of the cradle.

10. The boat transfer system according to claim 1, wherein said deployment frame comprises a docking head or latch for connection of the cradle.

* * * * *